United States Patent [19]

Ishikawa

[11] Patent Number: 4,481,853

[45] Date of Patent: Nov. 13, 1984

[54] ELECTRONIC KEYBOARD MUSICAL INSTRUMENT CAPABLE OF INPUTTING RHYTHMIC PATTERNS

[75] Inventor: Tomohisa Ishikawa, Tokyo, Japan

[73] Assignee: Casio Computer Co., Ltd., Tokyo, Japan

[21] Appl. No.: 396,780

[22] Filed: Jul. 9, 1982

Related U.S. Application Data

[63] Continuation of Ser. No. 190,608, Sep. 25, 1980, abandoned.

[51] Int. Cl.[3] ..... G10F 1/00

[52] U.S. Cl. ..... 84/1.03; 84/DIG. 12

[58] Field of Search ..... 84/1.01, 1.03, DIG. 12, 84/1.24

[56] References Cited

U.S. PATENT DOCUMENTS

| | | | |
|---|---|---|---|
| 3,878,750 | 4/1975 | Kapps | 84/1.01 |
| 4,058,043 | 11/1977 | Shibahara | 84/1.03 |
| 4,217,805 | 8/1980 | Tamada | 84/1.03 |
| 4,263,828 | 4/1981 | Aoki et al. | 84/1.03 |
| 4,339,978 | 7/1982 | Imamura | 84/1.03 |

*Primary Examiner*—Forester W. Isen

*Attorney, Agent, or Firm*—Frishauf, Holtz, Goodman & Woodward

[57] ABSTRACT

An electronic keyboard musical instrument is capable of inputting rhythmic patterns by setting desired rhythmic patterns in memory circuits using the keys of keyboards. The set rhythmic patterns operate a rhythm source circuit when read out from the memory circuits during performance and thereby output rhythm sounds.

13 Claims, 9 Drawing Figures

FIG. 3

| | |
|---|---|
| $C_2$ | BASS - DRUM |
| $C_2$# | SNARE - DRUM |
| $D_2$ | HIGH - HAT |
| $D_2$# | CYMBAL |
| $E_2$ | MARACAS |
| $F_2$ | CLAVES |
| $F_2$# | COW - BELL |
| $G_2$ | HIGH - BONGO |
| $G_2$# | LOW - BONGO |
| $A_2$ | HIGH - CONGA |
| $A_2$# | LOW - CONGA |
| $B_2$ | GUIRO |
| PEDAL $C_2$ | TIMING INPUT |

FIG. 4A
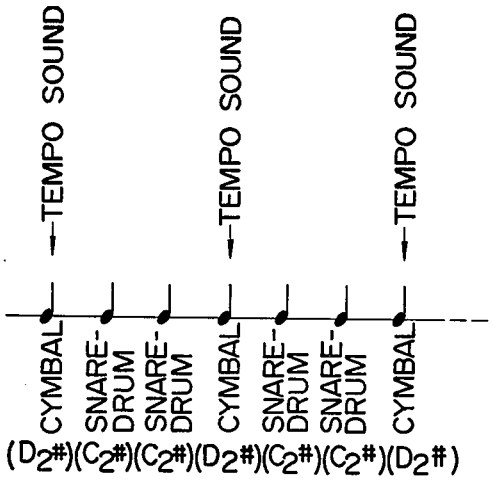
FIG. 4B
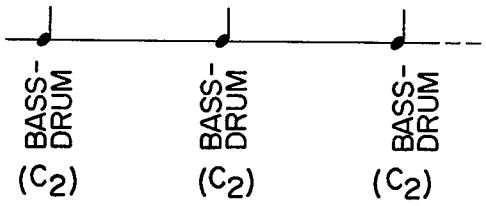
FIG. 4C
FIG 5A
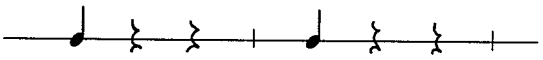
FIG. 5B
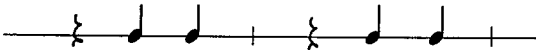
FIG. 5C
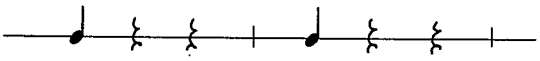

ELECTRONIC KEYBOARD MUSICAL INSTRUMENT CAPABLE OF INPUTTING RHYTHMIC PATTERNS

This is a continuation of application Ser. No. 190,608 filed Sept. 25, 1980, now abandoned.

BACKGROUND OF THE INVENTION

The present invention relates to an electronic keyboard musical instrument capable of inputting rhythmic patterns by keyboard operation.

In a conventional electronic keyboard musical instrument such as an electronic organ, a plurality of rhythmic patterns are stored in advance for rhythmic performance. By suitably operating a selection switch, a desired rhythmic pattern among the stored patterns is specified to be read out for rhythmic performance.

The rhythmic patterns which are commonly stored are waltz, rock, march, rhumba, beguine and so on.

However, the electronic organ of this type is defective in that the kind and number of rhythmic patterns available are limited. Therefore, the performance becomes very monotonous.

Recently, rhythm boxes and rhythm machines have been proposed in which a rhythmic pattern is stored by an input operation of the performer, so that the rhythmic performance is effected based on the set rhythmic pattern.

In this case, the input operation is effected by turning on or off predetermined switches by fingers or foot. However, the device for this is separated from the electronic musical instrument. As a result they require more space for installation. Since the device is separated from the electronic musical instrument, synchronous performance therewith has been generally difficult. Synchronism between the keyboard performance and the rhythmic performance has been difficult.

The present invention has been made to overcome these problems and has for its object to provide an electronic keyboard musical instrument which enables a performer to input a rhythmic pattern by keyboard operation.

SUMMARY OF THE INVENTION

To the above and other ends, the present invention provides an electronic keyboard musical instrument comprising a keyboard; a mode changeover switch for changing over between setting of rhythmic patterns and general performance, each key of the keyboard being changed over between a setting for general performance and a setting for inputting of rhythmic pattern; a memory in which a rhythmic pattern is set by manipulation of predetermined keys of the keyboard when the mode is set by the changeover switch for setting rhythmic patterns; and a percussive sound generating circuit for generating percussine sounds based on the rhythmic patterns set in the memory.

With an electronic keyboard musical instrument of the present invention, it is possible for a performer to set desired rhythmic patterns in an internal memory circuit for providing a desired rhythm with an extremely simple input operation using keys of the keyboard. It is advantageous in that it does not require an additional device separate from the musical instrument since the rhythmic pattern is set in the memory circuit inside the electronic keyboard musical instrument itself. Further, rhythmic performance of various patterns is possible since the operation may be effected in cooperation with various switches of the electronic keyboard musical instrument. Further, the desired rhythm may be used in combination with a rhythmic pattern set in advance in the electronic keyboard musical instrument. For example, rhythms based on a rhythmic pattern set by the manual operation of a performer may be utilized as fill-in rhythms.

BRIEF DESCRIPTION OF THE Drawings

FIG. 3 is a view showing the correspondence of respective keys of the manual keyboard with the rhythm instrument and the function of the key C2 of a pedal;

FIGS. 4A to 4C are views illustrating the successive input operation for setting the rhythmic pattern in memories M1 to M3; and FIGS. 5A to 5C are views illustrating the manner in which percussive sounds such as the sounds of cymbals, snare-drums, and bass-drums are outputted according to the rhythmic patterns set as in FIGS. 4A to 4C.

DETAILED DESCRIPTION

Figure 1:
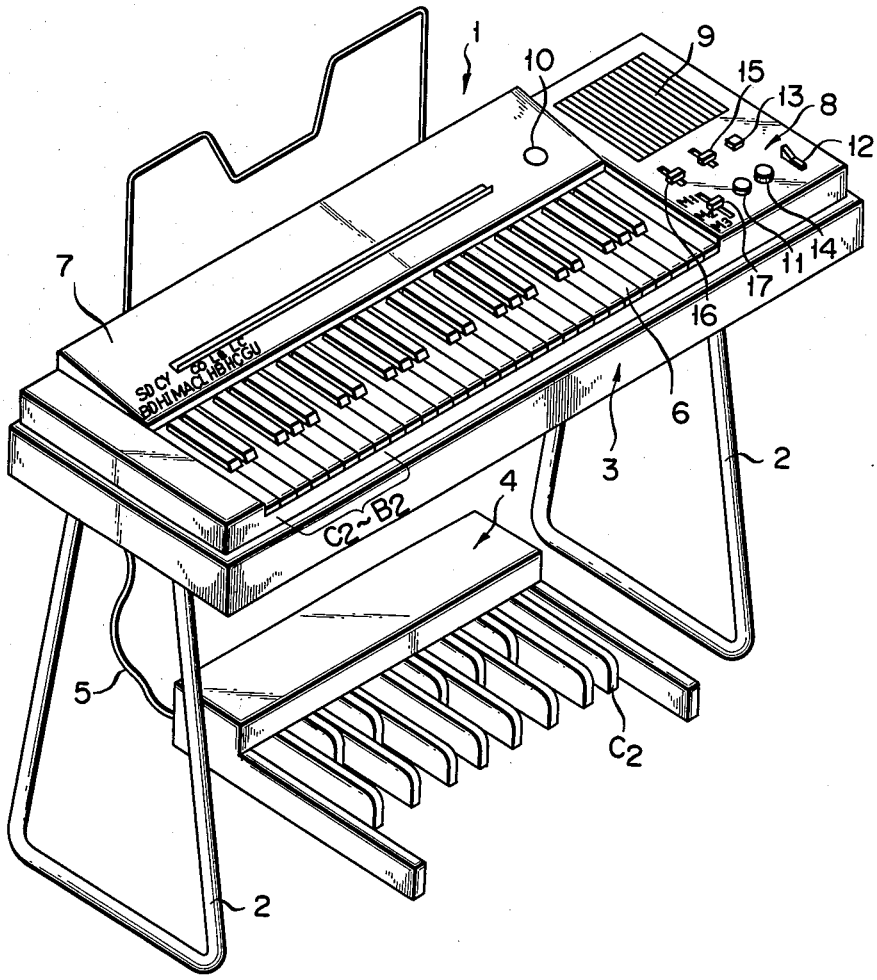
FIG. 1 is a perspective view illustrating the outer appearance of an electronic organ in accordance with the present invention.

An embodiment of the present invention as applied to an electronic organ will be described referring to the accompanying drawings. In FIG. 1, an electronic organ 1 comprises support legs 2, a machine body 3 supported by these support legs 2, and a pedal keyboard 4 electrically connected to the machine body 3 through a cable 5. A manual keyboard 6, a music stand 7, an operation unit 8, and a loud-speaker 9 are arranged on the machine body 3 as shown in the figure. The manual keyboard 6 has 49 keys from tones C1 to C6 for normal performance. Twelve keys of tones C2 to B2 correspond to rhythmic instruments of 12 kinds such as bass-drums, snare-drums, guiro and so on as shown in FIG. 3, and are used to store in a memory desired rhythmic patterns of a rhythmic instrument by operating these keys. The correspondence between the keys of the tones C2 to B2 and each rhythmic instrument indicated by symbols is displayed on the music stand 7 as shown in FIG. 1. The pedal keyboard 4 has 13 keys of tones C3 to C2. The key of the tone C2 is used for inputting timing for the rhythmic patterns of the keys of the tones C2 to B2. In this case, a tempo lamp 10 disposed on the music stand 7 is lit at the start of every measure, according to the tempo set by a tempo setting knob 11 disposed on the operation unit 8. Tempo sounds are thus produced from the loudspeaker 9. The operation of the key of the tone C2 of the pedal keyboard 4 while confirming the timing with the flashing of the lamp 10 and the tempo sounds are thus enabled.

In addition to the tempo setting knob 11, on the operation unit 8 are disposed a power source switch 12, a start/stop switch 13, a volume switch 14, a tone color setting knob 15, a mode changeover switch 16, and a memory changeover switch 17. The start/stop switch 13 starts or interrupts the rhythmic performance to be described hereinafter. The mode changeover switch 16 sets the electronic organ 1 to either the performing mode or the rhythmic pattern inputting mode. The memory changeover switch 17 specifies one of three memories M1, M2 and M3 (Random access memory, RAM) to be described hereinafter, when inputting the rhythmic patterns.

Figure 2:
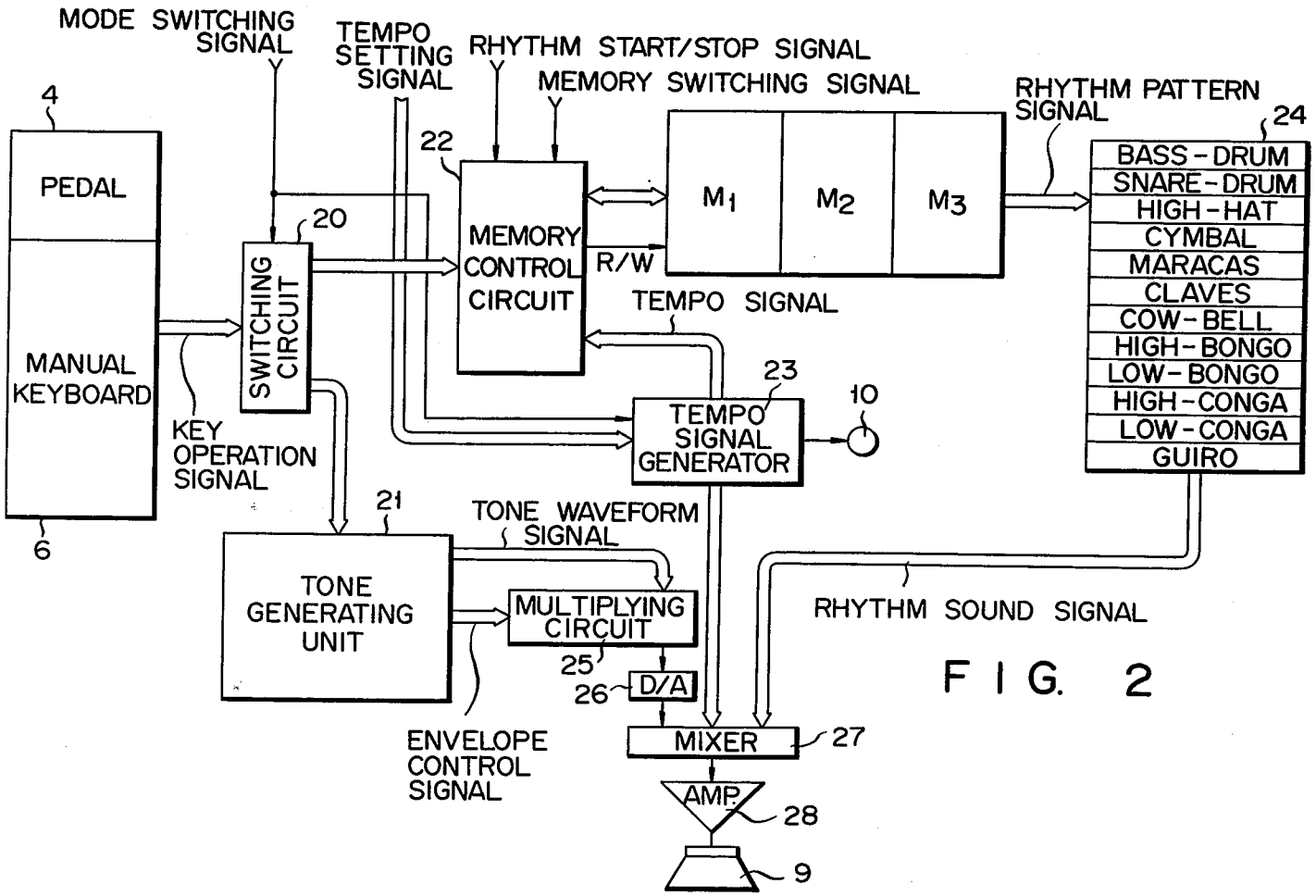
FIG. 2 shows a circuit block diagram of the electronic organ shown in FIG. 1.

The circuit construction will be described referring to FIG. 2. The key operation signals of the respective keys of the pedal keyboard 4 and the manual keyboard 6 are inputted to a switching circuit 20. The mode changeover signals are inputted by the mode changeover switch 16 to the switching circuit 20. When the mode chageover switch 16 is changed over to the performing mode, the switching circuit 20 sends the key operation signals to a tone generating unit 21. When the mode chageover switch 16 is changed over to the rhythmic pattern inputting mode, the switching circuit 20 transmits the key operation signals to a memory control circuit 22. The tone generating unit 21 is a circuit for generating a tone corresponding to the inputted key operation signal, and it outputs a tone waveform signal and an envelope control signal corresponding to each of the keys of the tones C3 to C2 of the pedal keyboard 4 and each of the keys of the tones C2 to C6 of the manual keyboard 6. The memory control circuit 22 is a circuit for controlling the reading and writing of rhythmic patterns in three memories M1, M2 and M3 (the data stored in these memories may be simultaneously read out, so that a complex rhythmic pattern may be inputted while dividing it into parts) which freely read and write the data. To the memory control circuit 22 are inputted a rhythm start/stop signal from the start/stop switch 13, a memory chageover signal from the memory changeover switch 17, and a tempo signal from a tempo signal generating unit 23. For storing a rhythmic pattern in the memories M1 to M3, one of the memories M1 to M3 is specified by the memory changeover signal; a writing command is outputted to the memories M1 to M3; and the key operation signals of the keys of the tones C2 to B2 of the manual keyboard 6 are inputted with the timing of the key operation of the tone C2 of the pedal keyboard 4 to a specified storage area within the specified memory of the memories M1 to M3 through the switching circuit 20 and the memory control circuit 22, for storing a desired rhythmic pattern. On the other hand, for reading out the rhythmic pattern data from the memories M1 to M3, a reading command is outputted to the memories M1 to M3, and rhythmic pattern data are simultaneously read out from the memories M1 to M3 to be transmitted to a rhythm source percussive sound generating means or 24 when the rhythmic start/stop signal is set to "start".

In addition to the mode changeover signal, a tempo setting signal is inputted to the tempo signal generator 23. The tempo signal generator 23 outputs to the memory control circuit 22, a tempo signal corresponding to the tempo setting signal, it flashes the lamp 10 at the start of every measure, and produces a tempo sound from the loud-speaker 9 in synchronism therewith. Reading and writing of the rhythmic patterns from and in the memories M1 to M3 are performed at a speed controlled by the tempo signal.

The percussive sound generating means or rhythm source 24 generates rhythmic sound signals of 12 kinds in response to the rhythmic pattern data. The rhythmic sound signal generated by the rhythm source 24 are inputted to a mixer 27. To the mixer 27 are further inputted a tempo signal, and a tone waveform signal provided with an envelope at a multiplying circuit 25 and converted into an analog signal at a digital/analog (D/A) converter 26. The mixer 27 mixes these three kinds of signals inputted as needed, and its output is amplified by an amplifier 28 and sounded at the loud-speaker 9.

The operation of the above embodiment will be described. For performing music by operating the keys, the power source switch 12 is turned on and the mode changeover switch 16 is operated to set the electronic organ 1 to the performing mode. When the keys of the pedal keyboard 4 and the manual keyboard 6 are operated, key operation signals are transmitted to the tone generating unit 21 through the switching circuit 20. The tone generating unit 21 outputs a tone waveform signal and an envelope control signal corresponding to the inputted key operation signal. The tone waveform signal is multiplied with the envelope control signal by the multiplying circuit 25, converted into an analog signal by the D/A converter 26, amplified by the amplifier 28 through the mixer 27, and sounded by the loud-speaker 9.

The operation for setting a rhythmic pattern in the memories M1 to M3 will be described with reference to FIGS. 4A to 4C. The mode changeover switch 16 is operated for setting the mode to the rhythmic pattern inputting mode. The memory M1, for example, is specified by the memory changeover switch 17 and the tempo setting knob 11 is operated for setting a desired tempo. Then, according to the set tempo, the lamp 10 is lit, a tempo sound is produced by the loud-speaker 9, a tempo signal (clock pulse) is transmitted as a time measuring data to the memory control circuit 22 in synchronism with the tempo sound and so on. The rhythmic pattern data with sounds of a cymbal and a snare-drum is inputted in the memory M1 as shown in FIG. 4A. According to the tempo sound and the lighting of the lamp 10, the inputting operation of the first measure is initiated. First, the key of the tone D2# in the manual keyboard 6 corresponding to the cymbal is depressed, and the key of the tone C2 of the pedal keyboard 4 is operated for inputting the timing. The operation signals of the keys of the tones D2# and C2 are transmitted to the memory control circuit 22 through the switching circuit 20. By the control operation of the memory control circuit 22, data specifying cymbal and data specifying the duration of the cymbal sound from the starting point are stored in the first storage area of the memory M1. At the second beat, the key of the tone C2# in the manual keyboard 6 corresponding to the snare-drum is operated, and the timing is inputted by the key of the tone C2 of the pedal keyboard 4. Then in a similar manner as described above, under the control of the memory control circuit 22, data specifying the snare-drum and data specifying the duration from the preceding cymbal sound to the snare-drum sound are stored in the next storage area of the memory M1. In the third beat, similarly as in the case of the second beat, data specifying the snare-drum is stored in the above-mentioned storage area of the memory M1. Then, when the lamp 10 is lit again and a tempo sound is produced, by the same key operation as in the first beat of the first measure, the data of the cymbal sound is written in the memory M1. The same key operation is performed at the second and third beats as in the second and third beats of the first measure, and the data of the snare-drum is written in the memory M1.

The desired rythmic pattern data of the cymbal and the snare-drum is stored in the memory M1 by the desired key operation for the third and succeeding measures.

When the setting of the rhythmic pattern in the memory M1 is terminated, the memory changeover switch 17 is changed over to the memory M2, and the rhythmic pattern data of, for example, a bass-drum is stored in the corresponding storage area of the memory M2 as shown in FIG. 4B. For this purpose, at the first beat of each measure, the key of the tone C2 of the manual keyboard 6 corresponding to the bass-drum and the key of the tone C2 of the pedal keyboard 4 for inputting the tempo are operated. Then, the memory changeover switch 17 is changed over to the memory M3 as needed, and a desired rhythmic pattern data of other rhythmic instruments is inputted to the memory M3 in a similar manner. In the case of the embodiment described, no data is inputted in the memory M3 as shown in FIG. 4C. The rhythmic performance utilizing the rhythmic patterns set in the memories M1 to M3 will be described. The mode changeover switch 16 is operated for setting the electronic organ 1 to the performing mode, and the tempo setting knob 11 is operated for setting the desired tempo. A tempo signal (clock pulse) is transmitted from the tempo signal generator 23 to the memory control circuit 22. Production of sounds will be performed according to this tempo.

The rhythm start/stop switch 13 is operated to output a "start" signal which is transmitted to the memory control circuit 22, and output of a reading command to all of the memories M1 to M3 is initiated. Thus, after the "start" signal has been outputted, the rhythmic pattern data of the cymbal, the bass-drum, and the snare-drum is read out from the memories M1 to M3 in synchronism with the start of the next measure, to be supplied to the rhythm source 24. Consequently, the rhythm source 24 is operated in response to the inputted rhythmic pattern data, and the output of the source 24 is supplied to the mixer 27. Thus, the tones of the combination of the melody and chord accompaniment which are manually performed and the rhythmic sounds according to the rhythmic pattern data read out from the memories M1 to M3 are produced from the loud-speaker 9. FIGS. 5A to 5C show the condition of the rhythmic performance in this case. FIG. 5A shows the output timing of the cymbal; FIG. 5B, of the snare-drum; and FIG. 5C, of the bass-drum. For stopping the rhythmic performance, the rhythm start/stop switch 13 is operated again to output a "stop" signal which is transmitted to the memory control circuit 22 for stopping the production of the rhythm sounds.

The present invention is not limited to the particular embodiment described above. For example, areas of the memories M1 to M3 may be arranged in correspondence with two continuous measures so that the rhythmic performance may be performed by reading out the rhythmic patterns of these two measures in repetition.

For setting the rhythmic pattern in the memories M1 to M3, the input rhythmic pattern may be read out under the control of the memory control circuit 22, and the new rhythmic pattern may be superposed on it while listening to the rhythm sounds based on the rhythmic pattern read out.

Although the key of the tone C2 of the pedal keyboard is the key for inputting timing in the above embodiment, the timing of the operated keys C2 to B2 for specifying the rhythm source may be stored as a sound generating timing.

A rhythm source other than the rhythm source shown in the above embodiment may be similarly used. The kind and number of rhythmic instruments may arbitrarily be selected.

A plurality of rhythmic patterns may be set permanently in an ROM (Read Only Memory) or the like for combination with the rhythmic pattern set by the performer for still better effects. In this case, the rhythmic pattern set by the performer may be used as a fill-in rhythmic pattern. In addition, a plurality of sets of rhythmic patterns may be set, and a desired rhythmic pattern may be selected for rhythmic performance. It is further possible, by the addition of a simple circuit, to automatically start the set rhythmic performance in synchronism with the manual performance or to automatically perform rhythmic accompaniment in synchronism with the chord output.

What is claimed is:

1. An electronic keyboard musical instrument including a keyboard having a plurality of keys each of which respectively coresponds to a different musical pitch, and a musical tone generating means coupled to said keyboard for generating musical tones in response to the operation of said keys of said keyboard, comprising:

changeover switching means coupled to said keyboard for changing over between a performance mode of operation of said keys of said keyboard for outputting musical tones from said musical tone generating means using the keys of said keyboard for specifying the pitches of the musical tones of at least one of a melody and an accompaniment of a musical piece, and a setting mode of operation of said keys of said keyboard for setting a percussive rhythmic pattern using said keys of said keyboard;

tempo signals generating means including means for generating tempo signals in real time and at user selectable timings, and means responsive to said tempo signals for providing a tempo indication perceptible to a performer, said tempo indication at least indicating the beginning of respective measures of music;

memory means coupled to said keyboard for storing as percussive rhythmic patterns the key operation patterns which are obtained by operating said keys of said keyboard in real time and in time with said tempo signals from said tempo signals generating means when said changeover switching means is in said setting mode of operation to thereby store said percussive rhythmic patterns in said memory means in real time;

percussive sound generating means coupled to said memory means for generating percussive sounds with timings in actual musical time according to said percussive rhythmic patterns stored in said memory means; and at least some of said keys of said keyboard being for specifying kinds of percussive sounds, and at least one of said keys being for inputting information corresponding to the output rhythmic timing of percussive sounds when said changeover switching means is changed over to said setting mode of operation; and at least some of the keys of said keyboard setting said rhythmic patterns when said changeover switching means is changed over to said setting mode of operation.

2. The electronic keyboard musical instrument of claim 1 wherein said memory means includes a plurality of memory units in each of a respective rhythmic patterns is stored independently of the others.

3. The electronic keyboard musical instrument of claim 2 wherein said rhythmic patterns individually stored in each memory unit of said memory means are simultaneously read out to be supplied to said percussive sound generating means.

4. The electronic keyboard musical instrument of claim 1 wherein said keys for specifying the kinds of said percussive sounds comprise keys of a manual keyboard and said key for inputting the information corresponding to the output rhythmic timing of said percussive sounds is a key of a pedal keyboard.

5. The electronic keyboard musical instrument of claim 1 further including memory means connected to said percussive sound generating means for storing a plurality of fixed rhythmic patterns set in advance.

6. The electronic keyboard musical instrument of claim 1 further including start/stop switching means for selectively initiating and terminating the supply of said rhythmic patterns to said percussive sound generating means.

7. The electronic keyboard musical instrument of any one of claim 1, wherein said means for providing said tempo indication includes means for providing a visual indication which is perceptible to the performer, said visual indication being generated at the beginning of respective measures of music.

8. An electronic keyboard musical instrument including a keyboard having a plurality of keys which respectively correspond to musical tones, and a musical tone generating means coupled to said keyboard for generating musical tones in response to the operation of said keys of said keyboard, comprising:

changeover switching means coupled to said keyboard for changing over between a performance mode of operation and said keys of said keyboard for outputting musical tones from said musical tone generating means using the keys of said keyboard for specifying the pitches of the musical tones of at least one of a melody and an accompaniment of a musical piece, and a setting mode of operation of said keys of said keyboard for setting a percussive rhythmic pattern using said keys of said keyboard;

tempo signals generating means including means for generating tempo signals in real time and at user selectable timings, and means responsive to said tempo signals for providing a tempo indication perceptible to a performer, said tempo indication at least indicating the beginning of respective measures of music;

memory means coupled to said keyboard for storing as percussive rhythmic patterns the key operation patterns which are obtained by operating said keys of said keyboard in real time and in time with said tempo signals from said tempo signals generating means when said changeover switching means is in said setting mode of operation to thereby store said percussive rhythmic patterns in said memory means in real time;

percussive sound generating means coupled to said memory means for generating percussive sounds with timings in actual musical time according to said percussive rhythmic patterns stored in said memory means;

said keyboard including keys for inputting said rhythmic patterns such that a given operated key specifies the kind of percussive sound, and a timing of operation of said operated key sets a timing of the output of said percussive sound from said percussive sound generating means when said changeover switching means is changed over to said setting mode of operation; and at least some of the keys of said keyboard setting said rhythmic patterns when said changeover switching means is changed over to said setting mode of operation.

9. The electronic keyboard musical instrument of claim 8 wherein said memory means includes a plurality of memory units in each of which a respective rhythmic pattern is stored independently of the others.

10. The electronic keyboard musical instrument of claim 9 wherein said rhythmic patterns individually stored in each memory unit of said memory means are simultaneously read out to be supplied in said percussive sound generating means.

11. The electronic keyboard musical instrument of claim 8 further including memory means connected to said percussive sound generating means for storing a plurality of fixed rhythmic patterns set in advance.

12. The electronic keyboard musical instrument of claim 8 further including start/stop switching means for selectively initiating and terminating the supply of said rhythmic patterns to said percussive sound generating means.

13. The electronic keyboard musical instrument of claim 8, wherein said means for providing said tempo indication includes means for providing a visual indication which is perceptible to the performer, said visual indication being generated at the beginning of respective measures of music.

* * * * *

UNITED STATES PATENT AND TRADEMARK OFFICE

CERTIFICATE OF CORRECTION

PATENT NO. : 4,481,853

DATED : November 13, 1984

INVENTOR(S) : Tomohisa ISHIKAWA

It is certified that error appears in the above-identified patent and that said Letters Patent is hereby corrected as shown below:

In the Abstract, line 3, after "using the keys of" insert --the--;

Column 1, line 52, after "inputting" change "of" to --a--;

Column 7 (claim 7), lines 22-23, after "instrument of" delete "any one of".

Signed and Sealed this

*Fourteenth* Day of *May 1985*

[SEAL]

*Attest:*

DONALD J. QUIGG

*Attesting Officer* *Acting Commissioner of Patents and Trademarks*